US009591897B2

(12) United States Patent
Ogura

(10) Patent No.: US 9,591,897 B2
(45) Date of Patent: Mar. 14, 2017

(54) SLIDE FASTENER WITH ANGLED ELEMENTS

(71) Applicant: YKK CORPORATION OF AMERICA, Marietta, GA (US)

(72) Inventor: Suguru Ogura, Macon, GA (US)

(73) Assignee: YKK Corporation (JP)

( * ) Notice: Subject to any disclaimer, the term of this patent is extended or adjusted under 35 U.S.C. 154(b) by 103 days.

(21) Appl. No.: 14/339,116

(22) Filed: Jul. 23, 2014

(65) Prior Publication Data

US 2016/0021989 A1 Jan. 28, 2016

(51) Int. Cl.

| | |
|---|---|
| ***A44B 19/02*** | (2006.01) |
| ***A44B 19/26*** | (2006.01) |
| ***A44B 19/04*** | (2006.01) |

(52) U.S. Cl.

CPC ..... *A44B 19/02* (2013.01); *A44B 19/04* (2013.01); *A44B 19/26* (2013.01)

(58) Field of Classification Search

CPC ..... A44B 19/02; A44B 19/26; A44B 19/04; A44B 19/06; A44B 19/267; A44B 19/00; Y10T 24/2582; Y10T 24/2557; Y10T 24/2561; Y10T 24/2502; Y10T 24/2504; Y10T 24/2545; Y10T 24/2539; Y10T 24/2595; Y10T 24/26; Y10T 24/2516; Y10T 24/2543; Y10T 24/255; B29C 66/43421

See application file for complete search history.

(56) References Cited

U.S. PATENT DOCUMENTS

| | | | | |
|---|---|---|---|---|
| 1,660,192 A | | 2/1928 | Freysinger | |
| 2,008,062 A | | 7/1935 | Clifford-Corner | |
| 2,300,443 A | * | 11/1942 | Wahl | A44B 19/34 24/403 |
| 2,469,509 A | | 5/1949 | Morin | |
| 2,491,197 A | * | 12/1949 | Morin | A44B 19/04 24/411 |
| 2,554,929 A | | 5/1951 | Gideon | |
| 2,600,905 A | | 6/1952 | Morin | |

(Continued)

FOREIGN PATENT DOCUMENTS

| | | |
|---|---|---|
| JP | 2006167191 | 6/2006 |
| WO | 2012059972 | 5/2012 |

OTHER PUBLICATIONS

Notice of Allowance, U.S. Appl. No. 29/497,363, mailed Aug. 20, 2015.

*Primary Examiner* — Robert J Sandy
*Assistant Examiner* — Matthew Sullivan
(74) *Attorney, Agent, or Firm* — Kilpatrick Townsend & Stockton LLP

(57) ABSTRACT

Slide fasteners configured such that opposing elements engage with one another in a non-planar relationship. The elements may engage one another, for example but not limited to, at an angle between approximately 60 degrees and approximately 179 degrees. In some embodiments, each element includes a head and at least one shoulder with angle keeping surfaces and engagement surfaces that abut corresponding surfaces when engaging with a corresponding element to interlock the heads and shoulders of opposing elements. Slide fasteners of the invention may be well suited for use with curved surfaces, corners, ridge lines, edges, or the like of an article.

23 Claims, 11 Drawing Sheets

(56) References Cited

U.S. PATENT DOCUMENTS 2,748,440 A * 6/1956 Ulrich ..... A44B 19/04 24/409
2,862,272 A * 12/1958 Morin ..... A44B 19/04 24/410
3,035,956 A * 5/1962 Gonda ..... B29C 65/02 156/201
3,055,070 A 9/1962 Morin
3,098,276 A * 7/1963 Rechsteiner ..... A44B 19/16 24/590.1
3,334,387 A * 8/1967 Gauthier ..... A44B 19/04 24/409
3,467,998 A * 9/1969 Kittredge ..... A44B 19/32 24/389
3,696,472 A * 10/1972 Perina ..... A44B 18/0003 24/406
4,309,798 A * 1/1982 Fraga ..... A44B 19/04 24/405
4,576,846 A * 3/1986 Noel ..... B29C 65/58 138/128
4,819,309 A * 4/1989 Behymer ..... F16B 3/00 24/586.11
4,905,694 A * 3/1990 Will ..... A61B 17/08 24/390
6,035,496 A 3/2000 Germani
6,681,456 B1 * 1/2004 Dischler ..... A44B 19/14 24/403
6,721,999 B2 * 4/2004 Meager ..... A44B 19/16 24/399
8,484,764 B2 * 7/2013 Damon ..... A44B 19/38 2/108
D740,169 S * 10/2015 Ogura ..... D11/221
2002/0157221 A1 * 10/2002 Chou ..... A44B 19/34 24/381
2006/0130292 A1 6/2006 Kondo et al.
2010/0306970 A1 * 12/2010 Tsao ..... A44B 19/06 24/406
2013/0205550 A1 8/2013 Kondo

* cited by examiner

SLIDE FASTENER WITH ANGLED ELEMENTS

FIELD OF THE INVENTION

Slide fasteners with elements that engage with one another at a predetermined angle when in the engaged position.

BACKGROUND

A slide fastener is used to secure the two pieces of fabric or other flexible material, such as on a garment or a bag or other article. A slide fastener includes a slider that engages with elements located on tapes to open and close the slide fastener. When the slider is moved along the tape, a generally Y-shaped channel meshes together rows of opposing elements of the tape to close the slide fastener. When the slider is moved in the opposite direction, the generally Y-shaped channel separates the rows of opposing elements to open the slide fastener.

When opposing elements are meshed together, the element axes of the elements are generally parallel (i.e., separated by 180 degrees) and the elements lie within the same plane. When the slide fastener is positioned along a curved surface, corner, ridge line, edge or the like of an article, the elements are required to bend and are thus subjected to undesirable forces in multiple directions that could break or damage the slide fastener. Moreover, it is difficult to attach traditional slide fasteners along a ridge line, corner, curved surface, edge or the like.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Disclosed are slide fasteners that are configured such that, when opposing elements are engaged with one another, the engaged elements are in a non-planar relationship. In some embodiments, an approximately 90 degree or any other suitable angle is formed between planes containing element axes of opposing elements when the elements are engaged. In non-limiting embodiments, each element includes a head and at least one shoulder having angle keeping surfaces and engagement surfaces that abut with corresponding surfaces of an opposing element to interlock the heads and shoulders of opposing elements and increase the cross-strength of the elements.

BRIEF DESCRIPTION OF THE DRAWINGS

Illustrative embodiments of the present invention are described in detail below with reference to the following drawing figures.

DETAILED DESCRIPTION

Disclosed are slide fasteners that are configured so that opposing elements of the tapes engage with one another at a predetermined angle in a non-planar relationship. In some cases, the predetermined angle can be selected to accommodate a particular article with which the slide fastener will be used. For example, the predetermined angle may be selected to accommodate a corner or edge or the like of an article.

Figure 1:
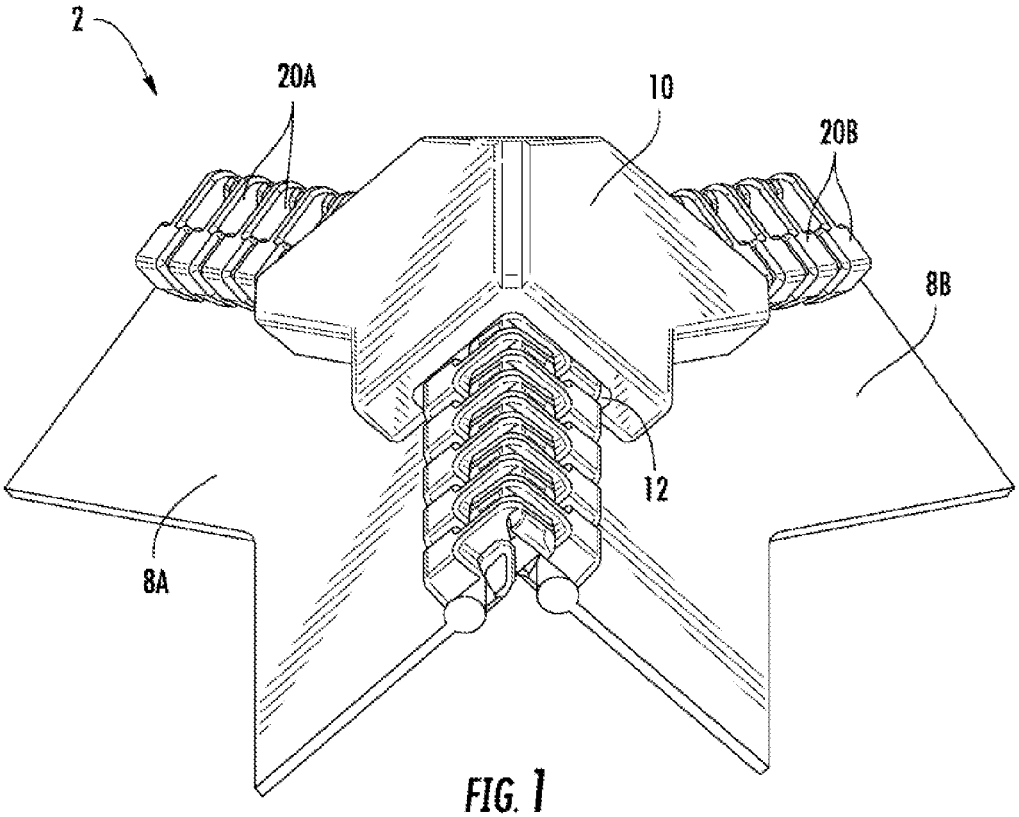
FIG. 1 is a perspective view of a portion of a slide fastener according to one embodiment.
Figure 2:
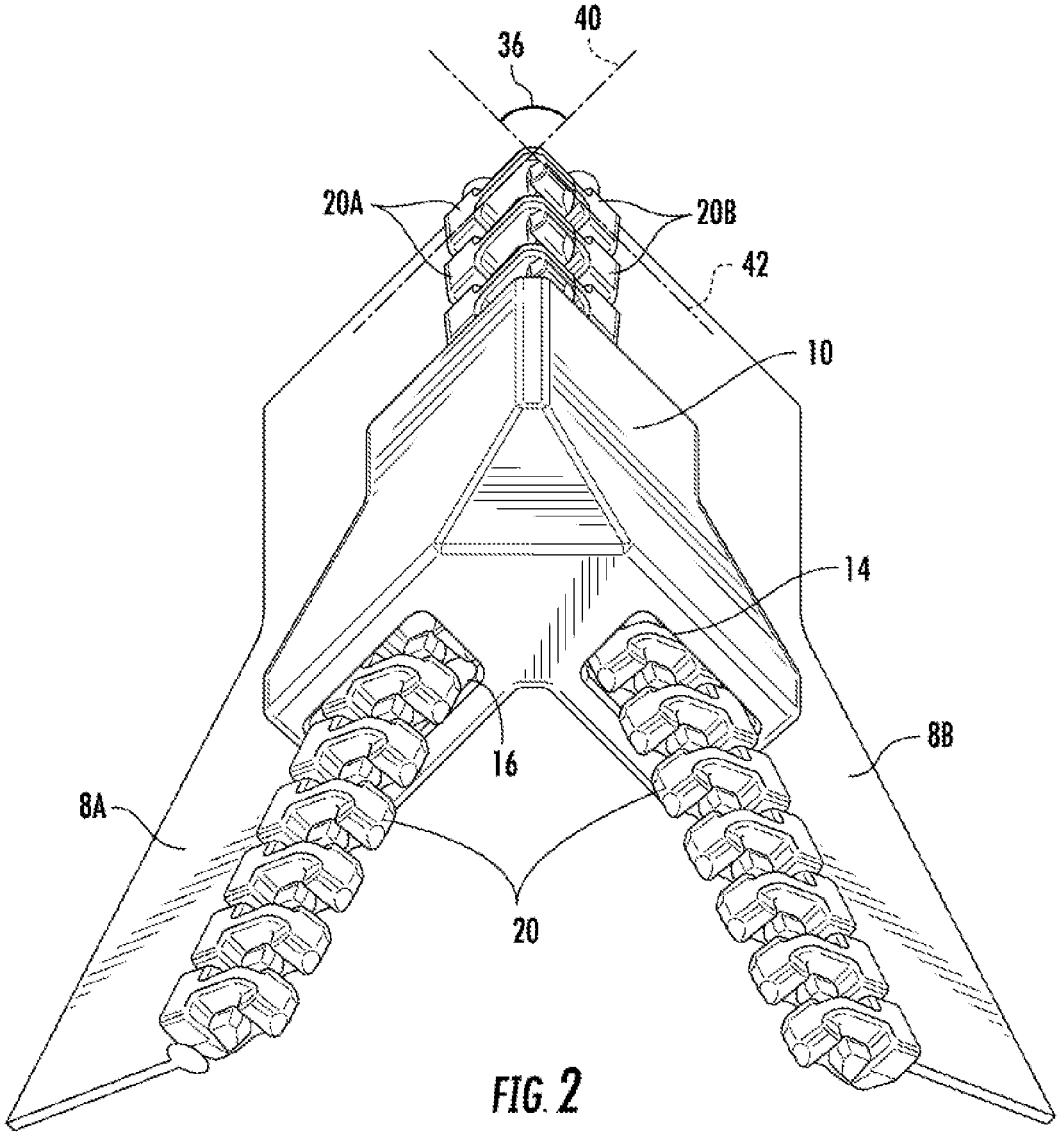
FIG. 2 is another perspective view of the slide fastener of FIG. 1.
Figure 3:
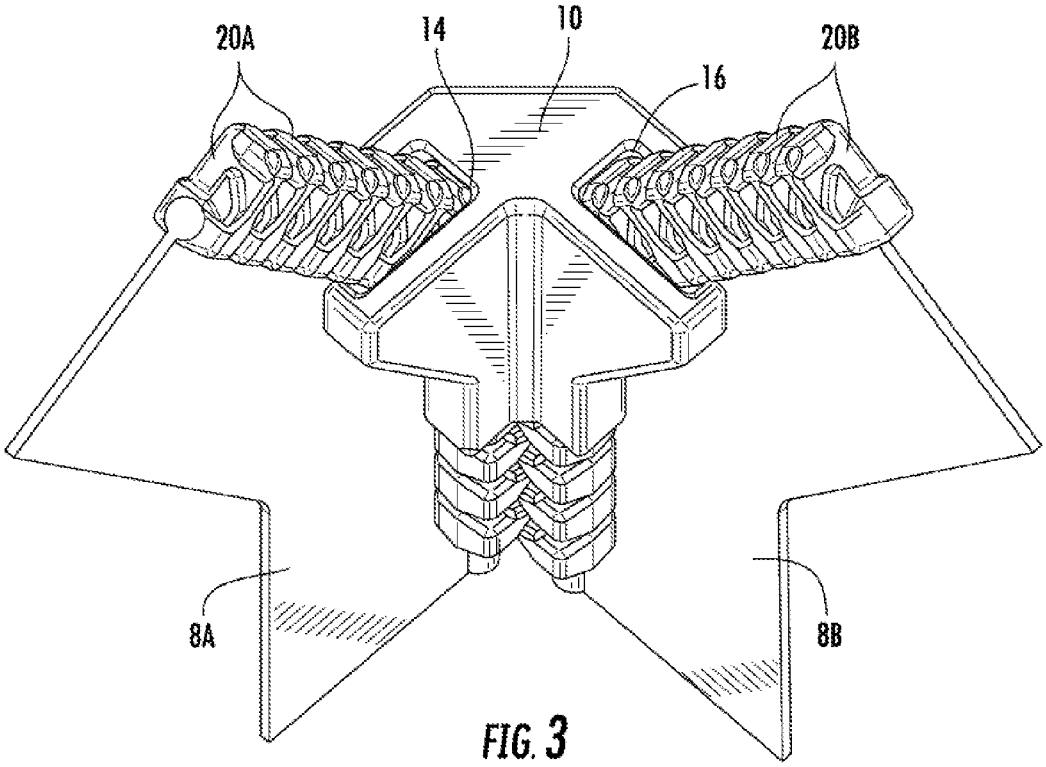
FIG. 3 is another perspective view of the slide fastener of FIG. 1.

The slide fastener 2 illustrated in FIG. 1 includes a slider 10 that cooperates with tapes 8A, 8B. Specifically slider 10 engages elements 20A, 20B located on opposite tapes 8A, 8B respectively. Each element 20A has an element axis 40 (FIGS. 2, 6, 8) that extends along the length of the element 20A. Each element also has a transverse axis 41 (see FIG. 8) that is perpendicular to the element axis 40, that extends in the side-to-side direction of the element 20A and is contained within an element transverse plane that bisects the element 20A from front to back. Each element 20B has an element axis 42 (FIG. 2) that extends along the length of the element 20B and a transverse axis 43 (not shown) that is perpendicular to the element axis 41, that extends in the side-to-side direction of the element 20B and is contained within an element transverse plane that bisects the element 20B from front to back.

As shown in FIGS. 1-2, 9 and 17, the elements 20A, 20B are configured so that element axes 40, 42 respectively of opposing elements (FIGS. 2 and 17) lie within first and second planes that intersect one another at a predetermined angle 36 when the slide fastener is in a closed position and the elements are engaged. As illustrated, the predetermined angle 36 is approximately 90 degrees, although the elements may be arranged to form any suitable angle when engaged. In some non-limiting examples, the predetermined angle, described in more detail below, is less than 180 degrees and can range from approximately 60 degrees to approximately 179 degrees.

Figure 4:
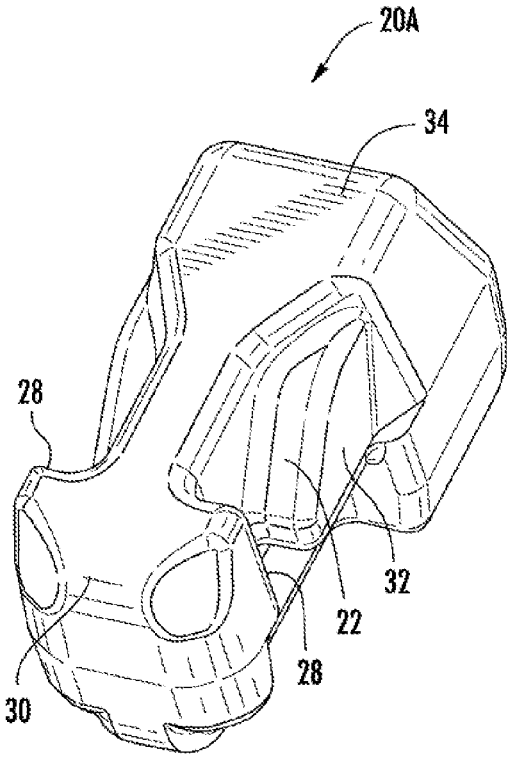
FIG. 4 is a perspective front view of an element in isolation according to one embodiment.
Figure 5:
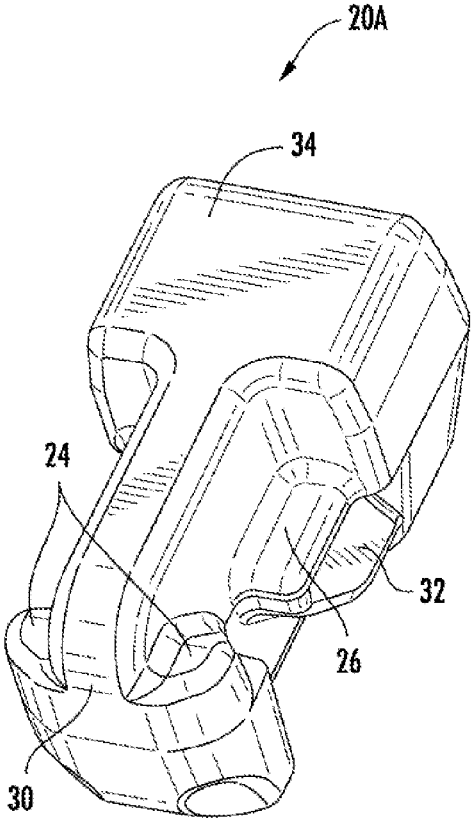
FIG. 5 is a perspective rear view of the element of FIG. 4.
Figure 6:
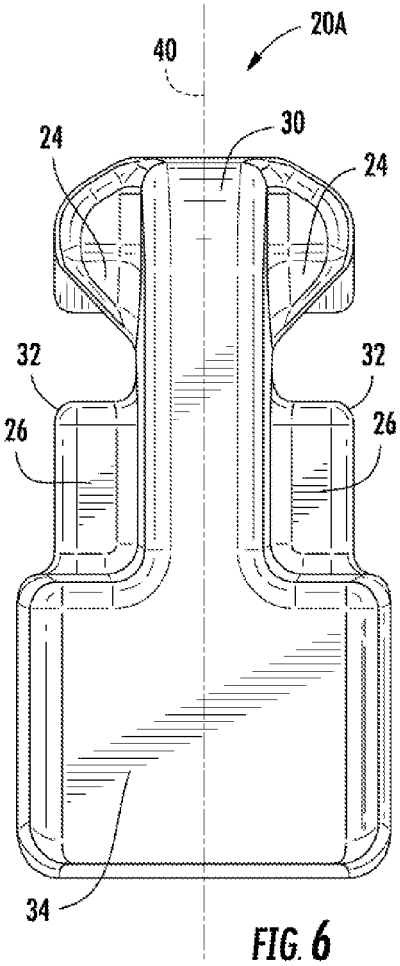
FIG. 6 is a rear view of the element of FIG. 4.
Figure 7:
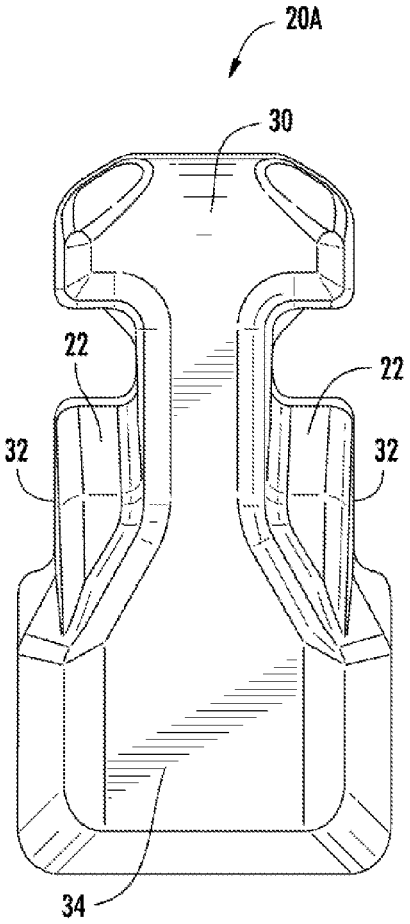
FIG. 7 is a front view of the element of FIG. 4.
Figure 8:
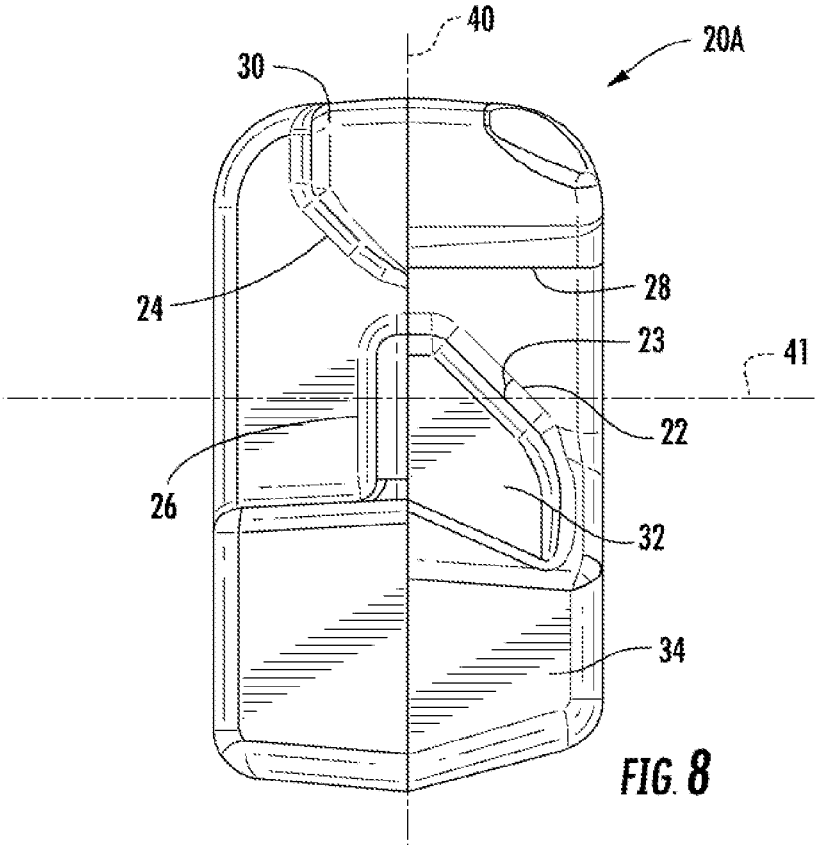
FIG. 8 is a side view of the element of FIG. 4.

FIGS. 4-8 show various views of one embodiment of an element 20A in isolation. Elements 20A may be made of any desired material including but not limited to any suitable plastic. In this particular embodiment, element 20A includes a head 30, a base 34 and two shoulders 32 positioned on opposite sides of the element 20 between the head 30 and the base 34. Each shoulder 32 includes a shoulder angle keeping surface 22 (FIGS. 4, 7, 8) and a shoulder engagement surface 26 (FIGS. 5, 6, 8). Head 30 includes two head angle keeping surfaces 24 (FIGS. 5, 6, 8) and two head engagement surfaces 28 (FIGS. 4 and 8).

Figure 9:
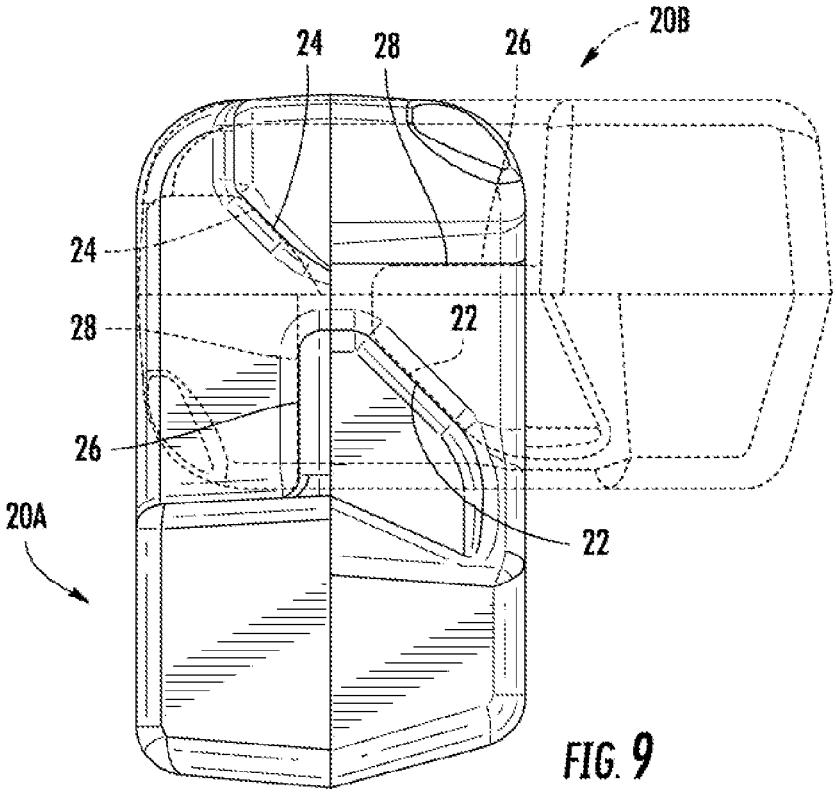
FIG. 9 is a side view illustrating the engagement of two elements according to one embodiment.
Figure 10:
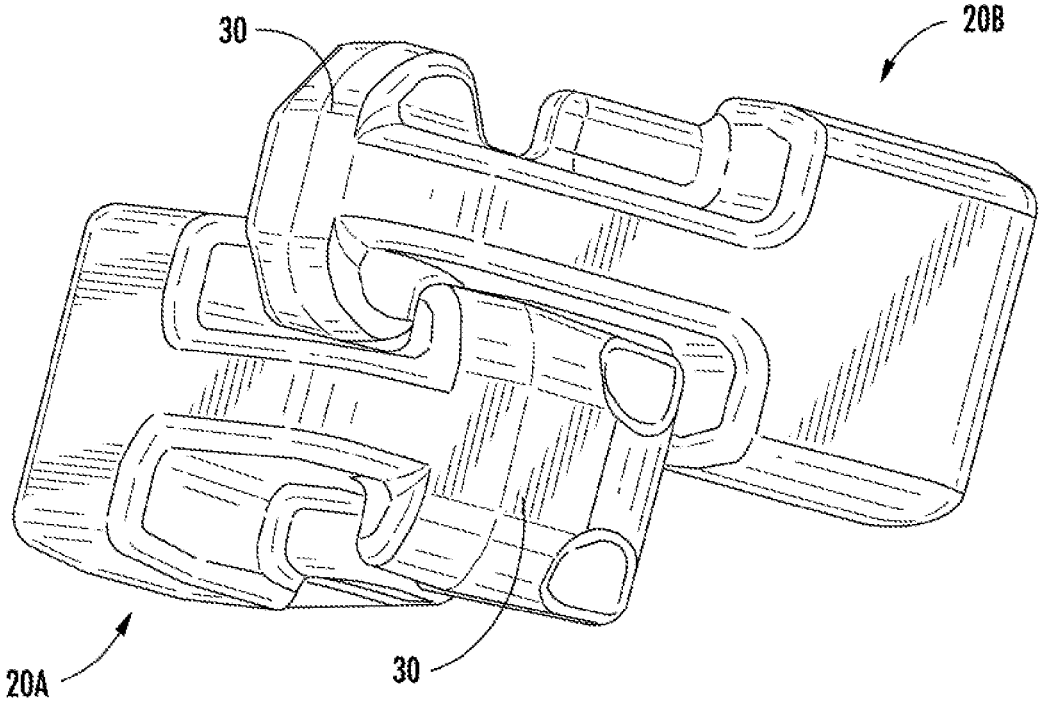
FIG. 10 is a perspective view illustrating the engaged elements of FIG. 9.

FIG. 9 shows the engagement of two opposing elements 20A, 20B, where element 20B is shown in phantom lines. When two opposing elements 20A, 20B are engaged: one of the head engagement surfaces 28 of a first element 20A abuts one of the shoulder engagement surfaces 26 of the engaged second element 20B; one of the shoulder engagement surfaces 26 of the first element 20A abuts one of the head engagement surfaces 28 of the second element 20B; one of the shoulder angle keeping surfaces 22 of the first element 20A abuts one of the shoulder angle keeping surfaces 22 of the second element 20B; and one of the head angle keeping surfaces 24 of first element 20A abuts one of the head angle keeping surfaces 24 of the second element 20B. In this way, both the heads 30 and the shoulders 32 of opposing elements (such as elements 20A, 20B) interlock with one another.

The abutment of the various surfaces described above helps maintain a sufficient cross-wise strength of the elements by maintaining contact between both the heads 30 and the shoulders 32 of the elements. Specifically, the cross-wise strength of the engaged elements is sufficient to counteract a pulling load applied to the elements by the tape and by the slider. In particular, each of the angle keeping and engagement surfaces of the shoulders 32 and head 30 of an engaged element abuts another of these surfaces, thus maintaining contact between not only the heads of opposing elements, but also the shoulders of opposing elements, and therefore maintaining the strength of the slide fastener and making it less susceptible to damage and failure. As illustrated, the various engagement and angle keeping surfaces are generally flat, although they need not be. In some embodiments, it may be desirable to dimension abutting surfaces so that they conform to one another to generate greater friction between the abutting surfaces and hence greater cross-wise strength.

The slope of the angle keeping surfaces 22 and 24 is correlated to the predetermined angle 36. In some embodiments, the slope 23 of the angle keeping surfaces 22 and 24, relative to the transverse plane that bisects the element from front to back and that contains the axis 41 (FIG. 8), is approximately half the predetermined angle 36. In some embodiments, the slope of the angle keeping surface 22 is generally the same as the slope of the angle keeping surface 24. In some cases, angle keeping surfaces 22 and 24 are generally parallel to one another. As stated above, the predetermined angle 36 of the illustrated engaged elements is approximately 90 degrees and thus the slope 23 of both the angle keeping surfaces 22 and 24 for this particular, non-limiting embodiment is approximately 45 degrees. If another predetermined angle 36 is desired, the slope 23 of the angle keeping surfaces 22, 24 would vary accordingly to adjust the predetermined angle 36.

Similarly, the orientation of the head engagement surface 28 relative to the shoulder engagement surface 26 for any particular element corresponds to the predetermined angle 36. As stated above, the predetermined angle 36 of the illustrated engaged elements is approximately 90 degrees. Thus, the head engagement surface 28 for this particular, non-limiting embodiment is oriented at an approximately 90 degree angle relative to the shoulder engagement surface 26, as shown in FIG. 8. If another predetermined angle 36 is desired, the orientation of the head engagement surface 28 relative to the shoulder engagement surface 26 would vary to generally match the predetermined angle 36.

Figure 11:
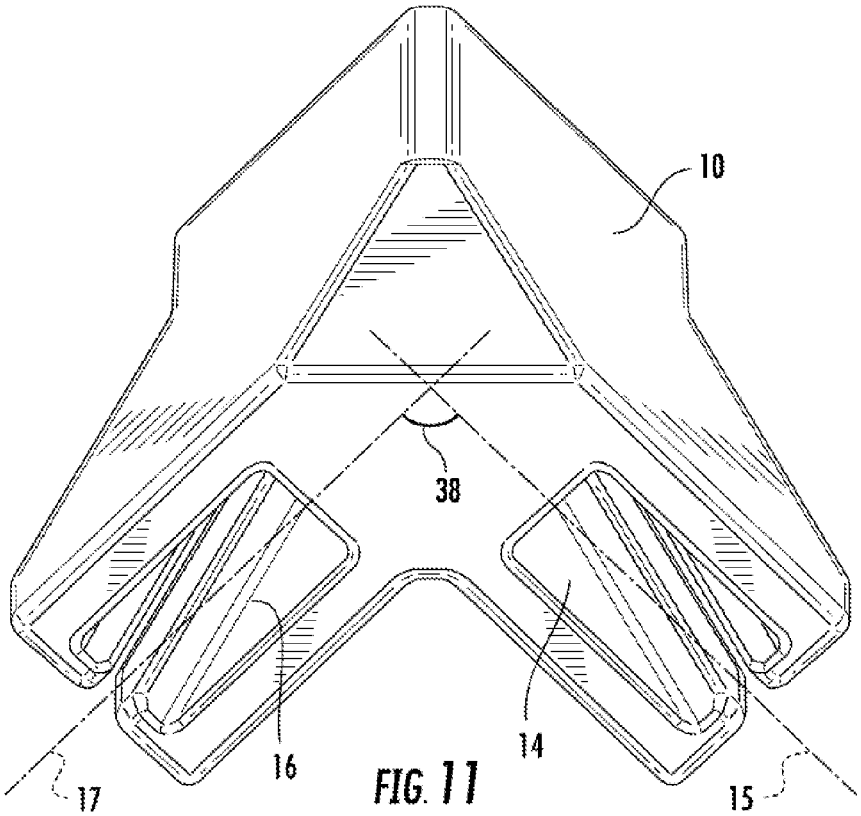
FIG. 11 is a perspective view of a first end of a slider according to one embodiment.
Figure 12:
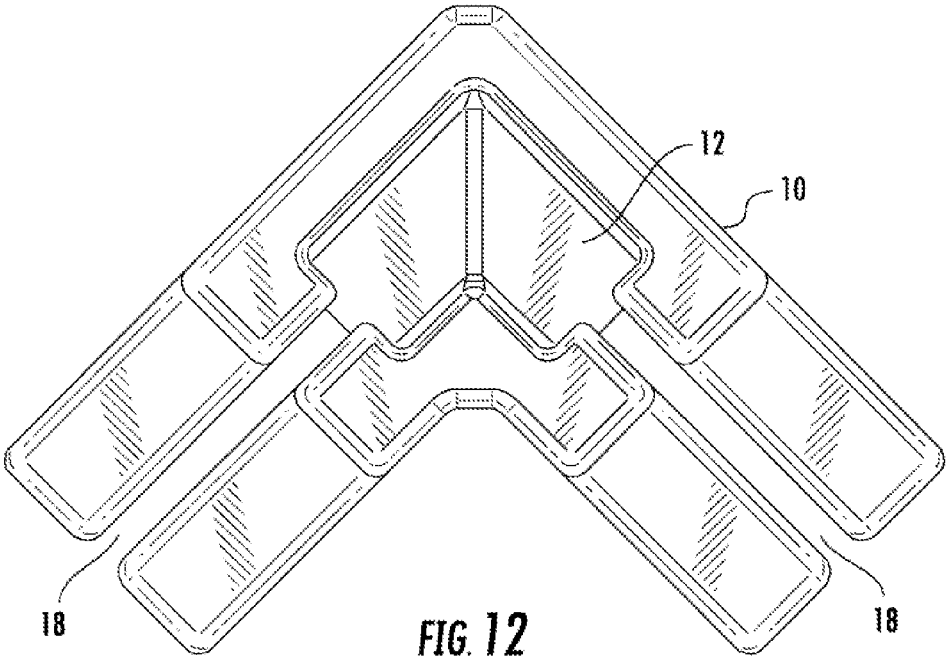
FIG. 12 is a view of a second end of the slider of FIG. 11.
Figure 13:
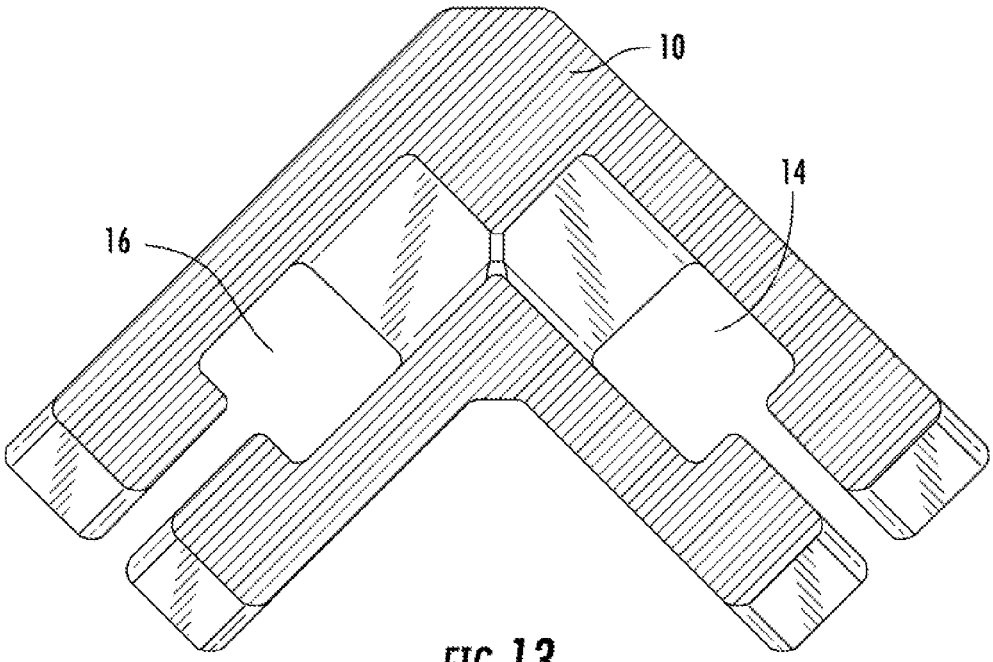
FIGS. 13-15 are various cross-sectional views of the slider of FIG. 11.
Figure 14:
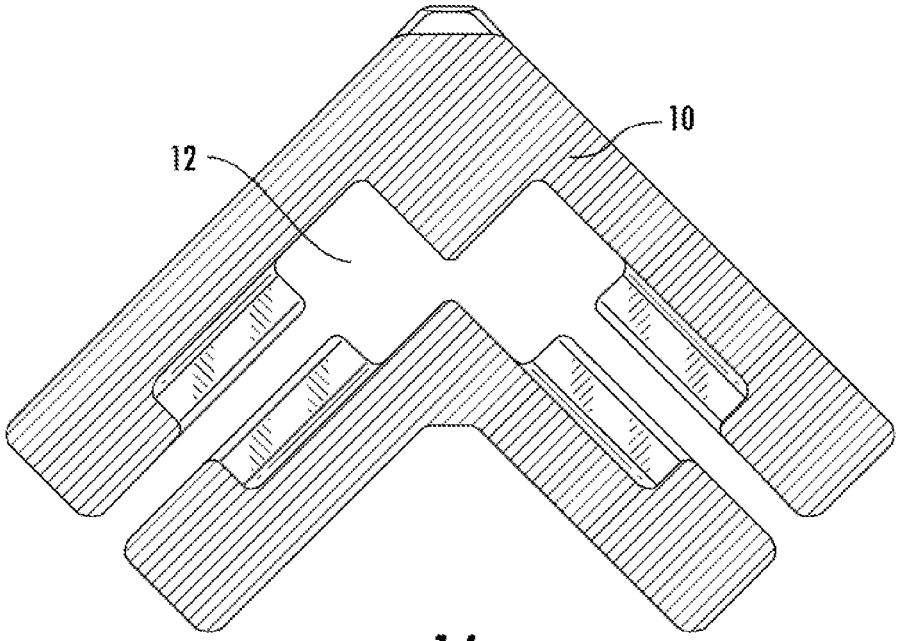
Figure 15:
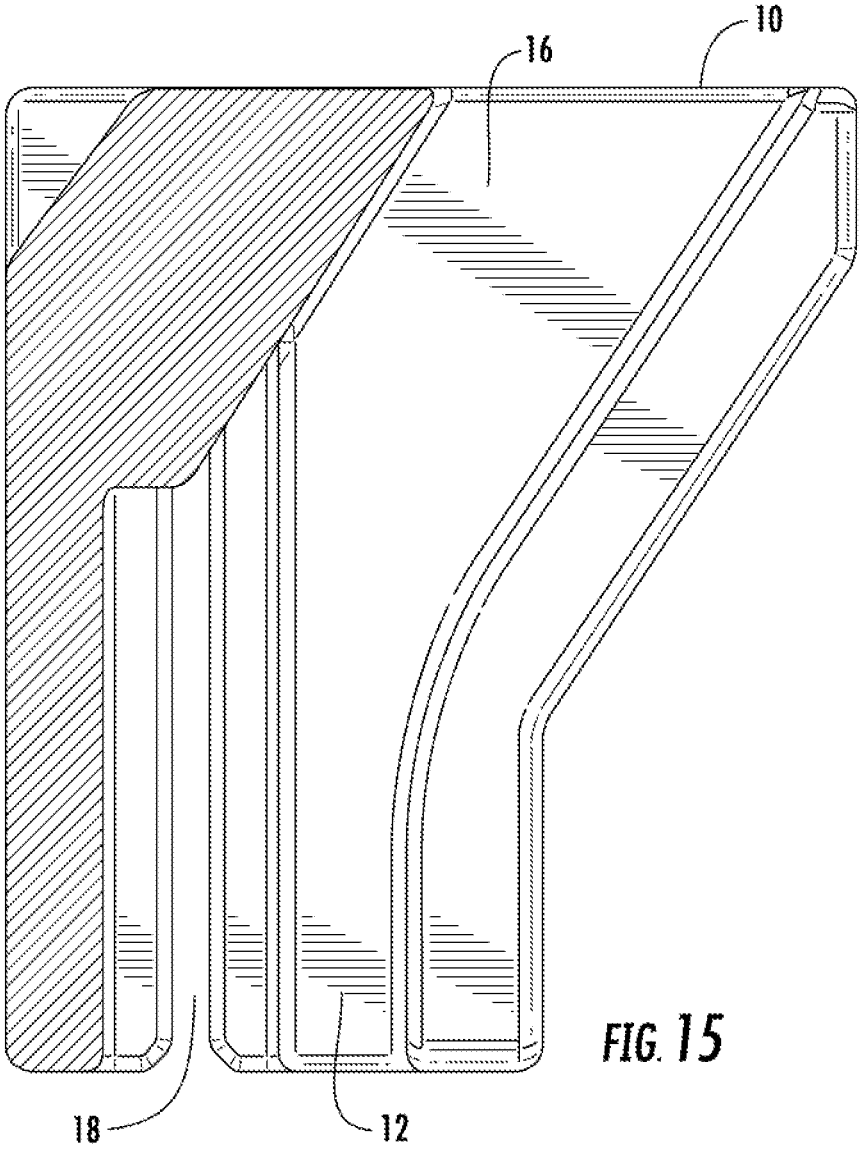
Figure 16:
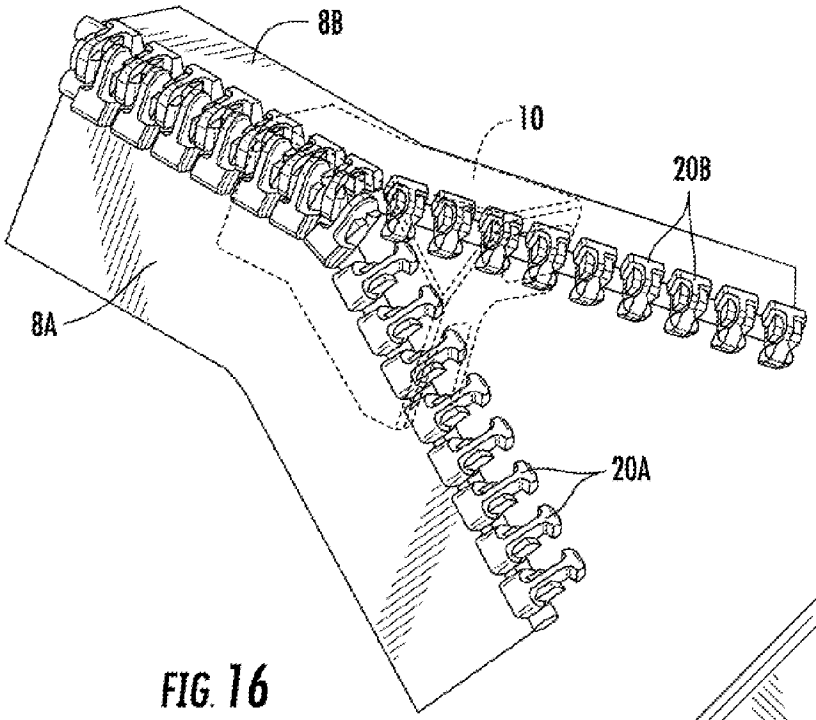
FIG. 16 is a see-through perspective view of the slider of FIG. 11 engaged with a tape according to one embodiment.
Figure 17:
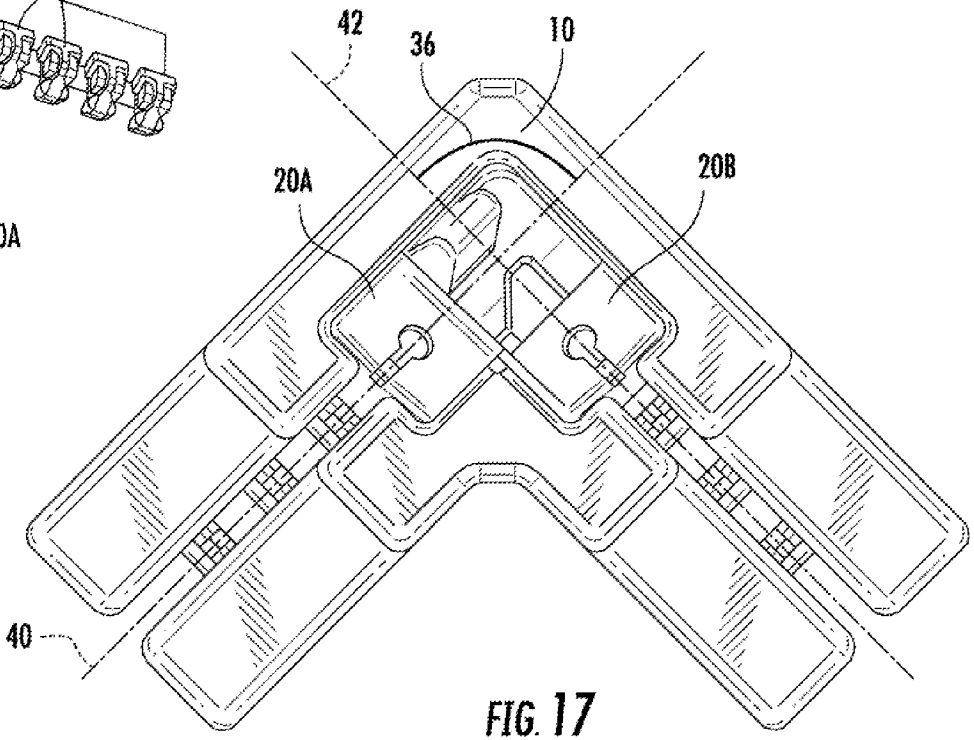
FIG. 17 is a see-through view of the slider of FIG. 11 engaged with tape elements.

Parts of slider 10 are also configured based on the predetermined angle 36. In particular, slider 10 includes tape gaps 18 (FIG. 12) for receiving tapes 8A, 8B and a channel 12 through which the elements 20A, 20B extend. As shown in FIG. 11, channel 12 includes a first upper portion 14 for receiving a plurality of first elements 20A and a second upper portion 16 for receiving a plurality of second elements 20B. The first upper portion 14 has a first upper portion axis 15 and the second upper portion 16 has a second upper portion axis 17 that are arranged to accommodate the predetermined angle 36 of the engaged elements. As noted, the predetermined angle of the engaged elements in the illustrated embodiment is approximately 90 degrees, and therefore an angle 38 between first upper portion axis 15 and second upper portion axis 17 is also illustrated as approximately 90 degrees, although the orientation of the first upper portion 14 and the second upper portion 16 can vary as needed to correspond to the predetermined angle. In this way, the angle 38 between the first upper portion 14 and the second upper portion 16 is generally the same as the predetermined angle 36 between engaged elements.

As noted above, the predetermined angle 36 may be selected based on the geometry of the article(s) with which the slide fastener will be used. As only one of many examples, if the portions of the article to be joined are generally perpendicular to one another, it may be desirable to set the predetermined angle at approximately 90 degrees. Because opposing elements are in a non-planar relationship when engaged with one another, the slide fasteners of this invention are well suited for use along curved surfaces, corners, edges, ridge lines, and the like. For example, the slide fasteners are easy to attach along a corner, edge, curved surface, ridge line, or the like and are durable because of the cross-wise strength of the engaged elements in various directions. The arrangement of the engaged elements at a predetermined angle also creates a stereoscopic effect.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A slide fastener comprising:

a plurality of first elements arranged along a first tape in a longitudinal direction of the first tape, wherein each of the plurality of first elements has a first element axis that extends along a length of the element from a base to a tip of each element in a direction substantially perpendicular to the longitudinal direction of the first tape, and wherein a first element plane extends in a direction substantially parallel to the longitudinal direction of the first tape and comprises the first element axis of each of the plurality of first elements;

a plurality of second elements arranged along a second tape in a longitudinal direction of the second tape, wherein each of the plurality of second elements has a second element axis that extends along a length of the element from a base to a tip of each element in a direction substantially perpendicular to the longitudinal direction of the second tape, and wherein a second element plane extends in a direction substantially parallel to the longitudinal direction of the second tape and comprises the second element axis of each of the plurality of second elements; and a slider comprising a leading edge and a trailing edge, the slider configured to engage each of the plurality of first elements with at least one of the plurality of second elements, wherein any one of the plurality of first elements forward of the leading edge of the slider is in a disengaged configuration with respect to a corresponding one of the plurality of second elements, wherein any one of the plurality of first elements rearward of the trailing edge of the slider is in an engaged configuration with respect to a corresponding one of the plurality of second elements, and wherein, in the engaged configuration, the first and second element planes intersect one another to define a predetermined angle between the first and second element planes that is less than 180 degrees.

2. The slide fastener of claim 1, wherein the predetermined angle is between approximately 60 degrees and approximately 179 degrees.

3. The slide fastener of claim 2, wherein the predetermined angle is approximately 90 degrees.

4. The slide fastener of claim 1, wherein each of the plurality of first and second elements comprises:

a head comprising two head angle keeping surfaces and two head engagement surfaces; and two shoulders on opposite sides of the element between the head and the base, wherein each of the shoulders comprises a shoulder angle keeping surface and a shoulder engagement surface, wherein:

each of the head angle keeping surfaces and the shoulder angle keeping surfaces is sloped, relative to an element transverse plane that bisects the element from front to back and that contains a transverse axis of the element, at an angle that is approximately half the predetermined angle, and each of the head engagement surfaces is oriented relative to each of the shoulder engagement surfaces at approximately the predetermined angle.

5. The slide fastener of claim 4, wherein, when the elements are in the engaged configuration:

one of the head engagement surfaces of one of the first elements abuts one of the shoulder engagement surfaces of one of the second elements;

one of the shoulder engagement surfaces of the one of the first elements abuts one of the head engagement surfaces of the one of the second elements;

one of the shoulder angle keeping surfaces of the one of the first elements abuts one of the shoulder angle keeping surfaces of the one of the second elements; and one of the head angle keeping surfaces of the one of the first elements abuts one of the head angle keeping surfaces of the one of the second elements.

6. The slide fastener of claim 4, wherein:

each of the head angle keeping surfaces is generally flat;

each of the shoulder angle keeping surfaces is generally flat;

each of the head engagement surfaces is generally flat; and each of the shoulder engagement surfaces is generally flat.

7. The slide fastener of claim 4, wherein a slope of the head angle keeping surfaces is approximately the same as a slope of the shoulder angle keeping surfaces.

8. The slide fastener of claim 7, wherein the slope of the head angle keeping surfaces and the slope of the shoulder angle keeping surfaces is between approximately 60 degrees and approximately 179 degrees relative to an element transverse plane that bisects the element from front to back and that contains a transverse axis of the element.

9. The slide fastener of claim 4, wherein each of the head engagement surfaces is oriented relative to each of the shoulder engagement surfaces between an angle of approximately 60 degrees and approximately 179 degrees.

10. The slide fastener of claim 4, wherein the head angle keeping surfaces are generally parallel with the shoulder angle keeping surfaces.

11. A slider comprising a channel comprising:

a first upper portion configured to receive a plurality of first tape elements and comprising a first upper portion axis contained within a first slider plane; and a second upper portion configured to receive a plurality of second tape elements and comprising a second upper portion axis contained within a second slider plane, wherein the first slider plane and the second slider plane intersect one another to define, from a front end of the slider to a rear end of the slider, an angle between the two planes that is between approximately 60 degrees and approximately 179 degrees.

12. The slider of claim 11, wherein the first slider plane and the second slider plane are non-planar to one another.

13. A slide fastener comprising:

a plurality of first elements arranged along a first tape in a longitudinal direction of the first tape, wherein each of the plurality of first elements has a first element axis that extends along a length of the element from a base to a tip of each element in a direction substantially perpendicular to the longitudinal direction of the first tape, and wherein a first element plane extends in a direction substantially parallel to the longitudinal direction of the first tape and comprises the first element axis of each of the plurality of first elements;

a plurality of second elements arranged along a second tape in a longitudinal direction of the second tape, wherein each of the plurality of second elements has a second element axis that extends along a length of the element from a base to a tip of each element in a direction substantially perpendicular to the longitudinal direction of the second tape, and wherein a second element plane extends in a direction substantially parallel to the longitudinal direction of the second tape and comprises the second element axis of each of the plurality of second elements; and a slider comprising a leading edge and a trailing edge, the slider configured to engage each of the plurality of first elements with at least one of the plurality of second elements, wherein any one of the plurality of first elements forward of the leading edge of the slider is in a disengaged configuration with respect to a corresponding one of the plurality of second elements, wherein any one of the plurality of first elements rearward of the trailing edge of the slider is in an engaged configuration with respect to a corresponding one of the plurality of second elements, and wherein, when the elements are in the engaged configuration, the first and second element planes are non-planar and intersect one another to define a predetermined angle between the two planes.

14. The slide fastener of claim 13, wherein the predetermined angle is between approximately 60 degrees and approximately 179 degrees.

15. The slide fastener of claim 13, wherein each of the plurality of first and second elements comprises:

a head comprising two head angle keeping surfaces and two head engagement surfaces; and two shoulders on opposite sides of the element between the head and the base, wherein each of the shoulders comprises a shoulder angle keeping surface and a shoulder engagement surface, wherein:

each of the head angle keeping surfaces and the shoulder angle keeping surfaces is sloped, relative to an element transverse plane that bisects the element from front to back and that contains a transverse axis of the element, at an angle that is approximately half the predetermined angle, and each of the head engagement surfaces is oriented relative to each of the shoulder engagement surfaces at approximately the predetermined angle.

16. The slide fastener of claim 15, wherein, when the elements are in the engaged configuration:

one of the head engagement surfaces of one of the first elements abuts one of the shoulder engagement surfaces of one of the second elements;

one of the shoulder engagement surfaces of the one of the first elements abuts one of the head engagement surfaces of the one of the second elements;

one of the shoulder angle keeping surfaces of the one of the first elements abuts one of the shoulder angle keeping surfaces of the one of the second elements; and one of the head angle keeping surfaces of the one of the first elements abuts one of the head angle keeping surfaces of the one of the second elements.

17. The slide fastener of claim 16, wherein:

each of the head angle keeping surfaces is generally flat;

each of the shoulder angle keeping surfaces is generally flat;

each of the head engagement surfaces is generally flat; and each of the shoulder engagement surfaces is generally flat.

18. The slide fastener of claim 16, wherein a slope of the head angle keeping surfaces is approximately the same as a slope of the shoulder angle keeping surfaces.

19. The slide fastener of claim 18, wherein the slope of the head angle keeping surfaces and the slope of the shoulder angle keeping surfaces is between approximately 60 degrees and approximately 179 degrees relative to an element transverse plane that bisects the element from front to back and that contains a transverse axis of the element.

20. The slide fastener of claim 16, wherein each of the head engagement surfaces is oriented relative to each of the shoulder engagement surfaces between an angle of approximately 60 degrees and approximately 179 degrees.

21. The slide fastener of claim 16, wherein the head angle keeping surfaces are generally parallel with the shoulder angle keeping surfaces.

22. The slide fastener of claim 16, wherein, when the elements are in the engaged configuration, the heads and the shoulders of the elements interlock with one another.

23. The slide fastener of claim 1, wherein the slider comprises a channel comprising:

a first upper portion configured to receive the plurality of first elements and comprising a first upper portion axis contained within a first slider plane; and a second upper portion configured to receive the plurality of second elements and comprising a second upper portion axis contained within a second slider plane, wherein the first slider plane and the second slider plane intersect one another to define an angle between the first slider plane and the second slider plane that is approximately equal to the predetermined angle.

* * * * *